US009341061B2

(12) United States Patent
Kennedy et al.

(10) Patent No.: US 9,341,061 B2
(45) **Date of Patent: *May 17, 2016**

(54) METHOD OF OPENING A MINE DOOR LEAF

(71) Applicant: Kennedy Metal Products & Buildings, Inc., Taylorville, IL (US)

(72) Inventors: William R. Kennedy, Taylorville, IL (US); John M. Kennedy, Taylorville, IL (US)

(73) Assignee: Jack Kennedy Metal Products and Buildings, Inc., Taylorville, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/321,408

(22) Filed: Jul. 1, 2014

(65) Prior Publication Data

US 2014/0311042 A1 Oct. 23, 2014

Related U.S. Application Data

(63) Continuation of application No. 12/708,948, filed on Feb. 19, 2010, now Pat. No. 8,800,204.

(51) Int. Cl.
*E21F 1/10* (2006.01)
*E21F 1/12* (2006.01)
(Continued)

(52) U.S. Cl.
CPC ..... *E21F 1/10* (2013.01); *E05F 15/614* (2015.01); *E05F 15/627* (2015.01); *E05F 15/63* (2015.01); *E06B 7/04* (2013.01); *E21F 1/12* (2013.01); *E05Y 2201/224* (2013.01); *E05Y 2201/624* (2013.01); *E05Y 2201/626* (2013.01);
(Continued)

(58) Field of Classification Search
CPC ..... E05F 15/63; E05F 15/627; E05F 15/614; E06B 7/04; E06B 2003/7052; E06B 3/362; E21F 1/10
USPC ..... 49/116, 118, 138, 340, 341, 345, 366, 49/367, 276, 277, 339, 506
See application file for complete search history.

(56) References Cited

U.S. PATENT DOCUMENTS 584,809 A 6/1897 Anthony
988,622 A 4/1911 Bowman
(Continued)

OTHER PUBLICATIONS

Articulate-Define The American Heritage® Dictionary of the English Language, Fourth Edition copyright © 2000 by Houghton Mifflin Company. Updated in 2009. Published by Houghton Mifflin Company. All rights reserved. http://www.thefreedictionary.com/articulate, 3 pgs.
(Continued)

*Primary Examiner* — Gregory Strimbu
(74) *Attorney, Agent, or Firm* — Senniger Powers LLP

(57) ABSTRACT

A method of opening a mine door leaf installed in a mine passageway having a high pressure zone and a low pressure zone. The method includes the steps of operating a variable-throw crank mechanism in a first configuration having a first crank length to apply a first force to the mine door leaf to move at a first speed, operating the variable-throw crank mechanism in a second configuration having a second crank length less than the first crank length to apply a second force greater than the first force to the mine door leaf to move at a second speed slower than the first speed, and using a resistance pressure associated with the high and low pressure zones in the mine passageway to convert the variable-throw crank mechanism from the first configuration to the second configuration.

19 Claims, 11 Drawing Sheets

(51) Int. Cl.

| | |
|---|---|
| ***E06B 7/04*** | (2006.01) |
| ***E05F 15/614*** | (2015.01) |
| ***E05F 15/627*** | (2015.01) |
| ***E05F 15/63*** | (2015.01) |
| *E06B 3/36* | (2006.01) |
| *E06B 3/70* | (2006.01) |

(52) U.S. Cl.

CPC ..... *E05Y2201/644* (2013.01); *E05Y 2800/37* (2013.01); *E05Y 2800/71* (2013.01); *E05Y 2900/11* (2013.01); *E05Y 2900/116* (2013.01); *E05Y 2900/132* (2013.01); *E05Y 2900/40* (2013.01); *E06B 3/362* (2013.01); *E06B 2003/7057* (2013.01)

(56) References Cited

U.S. PATENT DOCUMENTS

| | | | | |
|---|---|---|---|---|
| 1,291,910 | A | | 1/1919 | Johnson |
| 1,318,349 | A | | 10/1919 | Boos |
| 1,376,248 | A | | 4/1921 | Boggio |
| 1,446,340 | A | | 2/1923 | Ferguson |
| 1,510,600 | A | | 10/1924 | Miller |
| 1,563,827 | A | | 12/1925 | Boggio |
| 1,620,669 | A | * | 3/1927 | Littlejohn ..... 49/240 |
| 1,748,448 | A | | 2/1930 | Gurney |
| 1,903,384 | A | | 4/1933 | Cooke |
| 2,257,759 | A | | 10/1941 | Niemann |
| 2,924,449 | A | | 2/1960 | Leimer et al. |
| 3,654,873 | A | | 4/1972 | Floehr |
| 3,708,915 | A | | 1/1973 | Davey |
| 4,185,415 | A | | 1/1980 | LaConte |
| 4,522,321 | A | | 6/1985 | Kinoshita |
| 4,610,046 | A | | 9/1986 | Buschur et al. |
| 5,018,304 | A | | 5/1991 | Longoria |
| 5,040,331 | A | | 8/1991 | Merendino et al. |
| 5,618,080 | A | * | 4/1997 | Sullivan et al. ..... 296/155 |
| 5,752,344 | A | | 5/1998 | Richmond |
| 5,930,954 | A | | 8/1999 | Hebda |
| 6,067,753 | A | | 5/2000 | Hebda |
| 6,105,447 | A | | 8/2000 | Linn |
| 6,425,820 | B1 | | 7/2002 | Kennedy et al. |
| 6,766,616 | B2 | | 7/2004 | Richter |
| 6,883,275 | B2 | | 4/2005 | Hellinga et al. |
| 6,938,372 | B2 | | 9/2005 | Kennedy et al. |
| 6,955,594 | B2 | | 10/2005 | Kennedy et al. |
| 7,118,472 | B2 | | 10/2006 | Kennedy et al. |
| 7,293,819 | B2 | | 11/2007 | Duffy |
| 8,161,681 | B2 | | 4/2012 | Treihaft |
| 8,169,169 | B2 | | 5/2012 | Hass et al. |
| 8,341,889 | B2 | | 1/2013 | Faulkner et al. |
| 2002/0092237 | A1 | | 7/2002 | Hebda |
| 2004/0261319 | A1 | | 12/2004 | Kennedy et al. |
| 2010/0223853 | A1 | | 9/2010 | Daniel-Wayman et al. |

OTHER PUBLICATIONS

Configuration-Define The American Heritage® Dictionary of the English Language, Fourth Edition copyright © 2000 by Houghton Mifflin Company. Updated in 2009. Published by Houghton Mifflin Company. All rights reserved http://www.thefreedictionary.com/Configuration, 3 pgs.

Four-bar analysis (Hebda, Spreadsheet, Clarence W. Mayott, PhD, May 10, 2012), 2 pgs.

* cited by examiner

METHOD OF OPENING A MINE DOOR LEAF

CROSS REFERENCE TO RELATED APPLICATIONS

This application is a continuation of U.S. application Ser. No. 12/708,948, filed Feb. 19, 2010 now U.S. Pat. No. 8,800, 204, the entire contents of which is hereby incorporated by reference.

FIELD OF THE INVENTION

The present invention generally relates to mine ventilation equipment, and more particularly to a mechanism for opening a mine door.

BACKGROUND OF THE INVENTION

Mine doors are frequently used throughout a mine to control ventilation. The doors are typically large and heavy, and they are often opened and closed using hydraulic or pneumatic mechanisms. Examples of such mechanisms are described in U.S. Pat. Nos. 6,425,820, 6,938,372 and 7,118, 472. While such mechanisms are generally reliable, they do have certain drawbacks, including complexity and expense. Also, since mine doors are very heavy and subject to large opening and closing pressures due to air flow in the mine, prior mechanisms are designed to move a mine door at slow speeds, which can waste valuable time. Further, the failure of a complex hydraulic or pneumatic mechanism may take substantial time to repair, which can severely impede operations in the mine.

There is a need, therefore, for an improved mine-door opening mechanism.

SUMMARY OF THE INVENTION

This invention is directed to a mine door system comprising a mine door comprising at least one door leaf adapted to be hinged at one side to a door frame defining an entry. The system includes an articulated door-moving mechanism that articulates between a first configuration in which the mechanism applies a relatively small door-moving force to the at least one door leaf and moves it at a first speed and a second configuration in which the mechanism applies a larger door-moving force to the at least one door leaf and moves it at a second speed less than the first speed.

The present invention is directed to a method of opening a mine door leaf installed in a mine passageway having a high pressure zone and a low pressure zone. The method comprises the steps of operating a variable-throw crank mechanism in a first configuration having a first crank length to apply a first force to the mine door leaf to move it at a first speed, operating the variable-throw crank mechanism in a second configuration having a second crank length less than the first crank length to apply a second force greater than the first force to the mine door leaf to move it at a second speed slower than the first speed, and using a resistance pressure associated with the high and low pressure zones in the mine passageway to convert the variable-throw crank mechanism from the first configuration to the second configuration.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
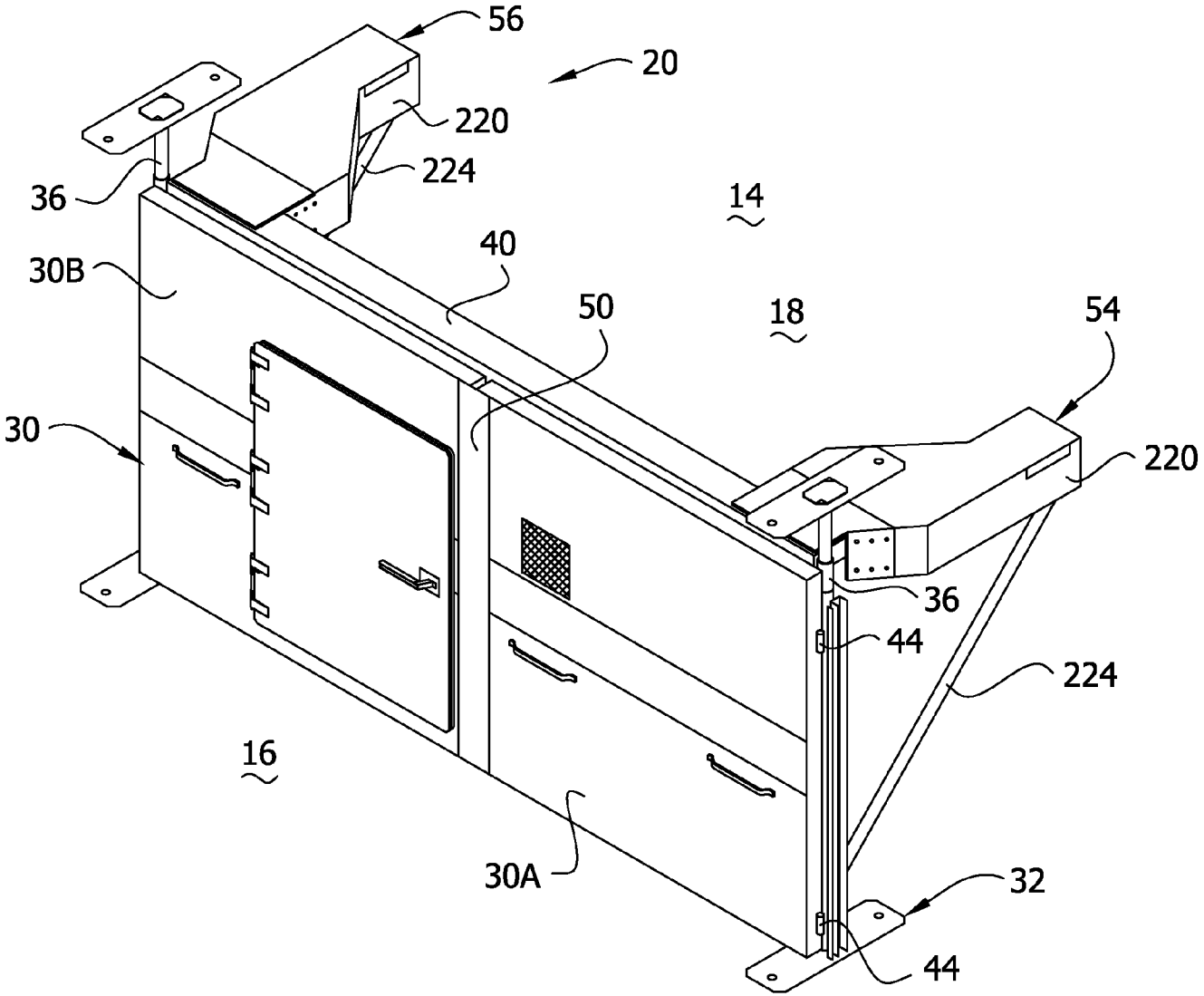
FIG. 1 is a perspective view of a mine door installation incorporating articulated door-moving mechanisms of this invention.
Figure 2:
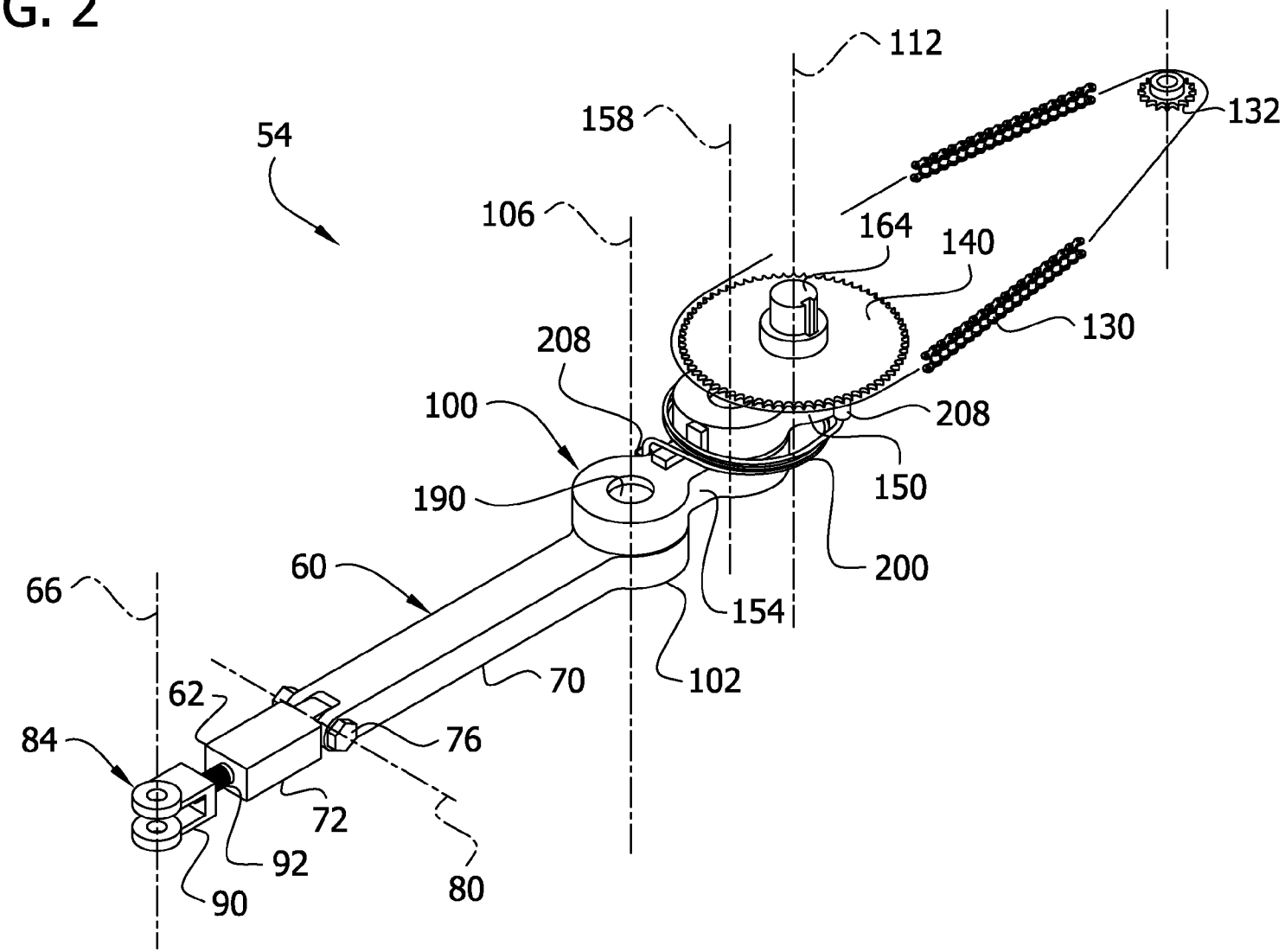
FIG. 2 is a perspective of components of one of the articulated door-moving mechanisms of FIG. 1.

Referring now to the drawings, FIGS. 1 and 2 illustrate an exemplary mine door system of this invention, generally designated 20. The system is adapted to be installed in a mine passageway 14 that has a high pressure zone 16 and a low pressure zone 18. In normal mine operation, the high pressure zone 16 (which is in fresh air) is on the side of the mine door system 20 most adjacent the mine entrance or in a passageway that during normal flow of air does not receive air that has passed along the mine face, and the low pressure zone 18 is the side of the mine door system 20 closest to the mine face where ore or mineral is being mined. However, the door system 20 can be placed in the return air of a mine (downstream from the mine face), in which case the high pressure zone 16 would be on the side of the door system closest the mine face, and the low pressure zone would be on the opposite side of the door system.

Figure 7:
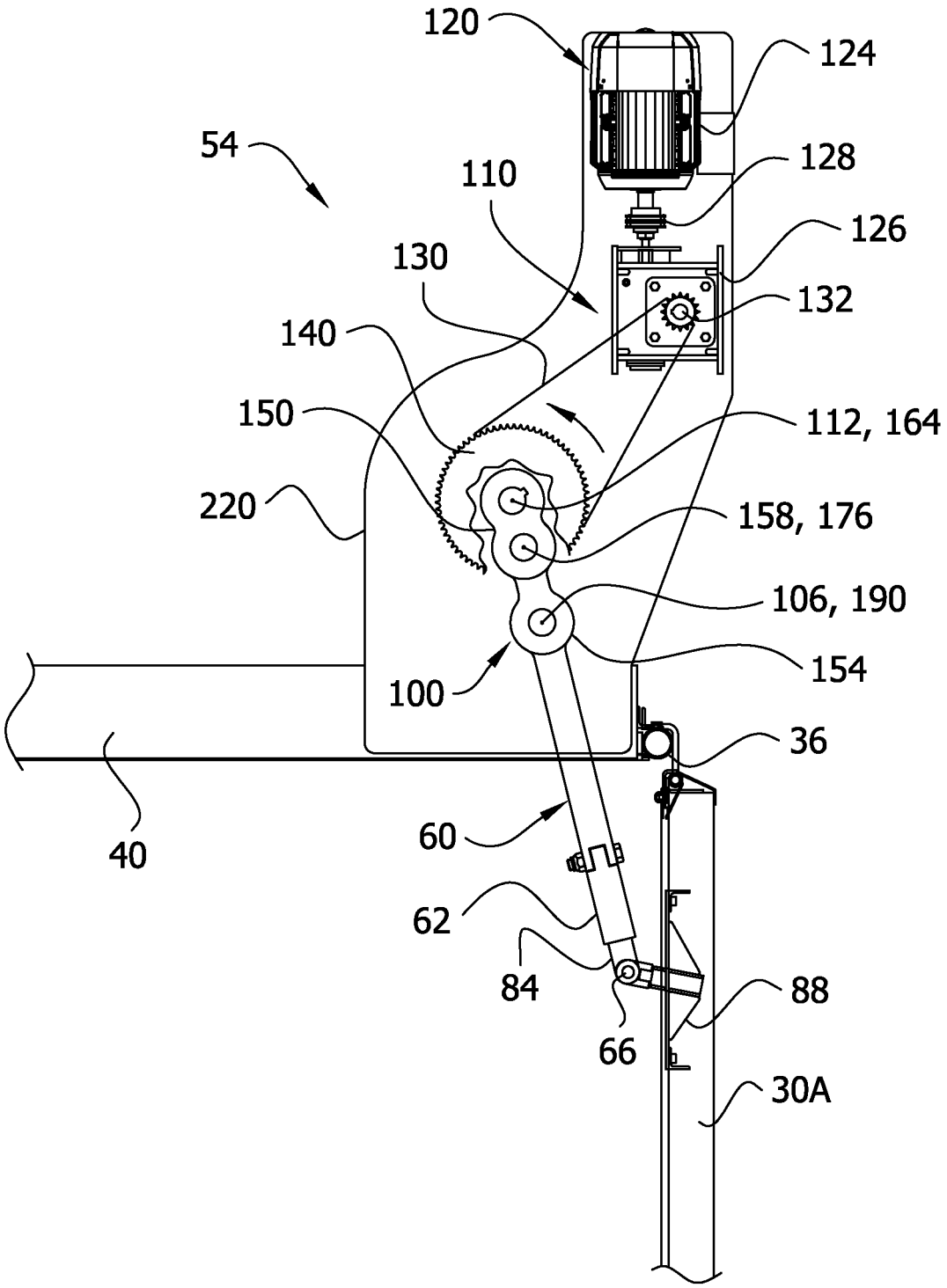
Figure 8:
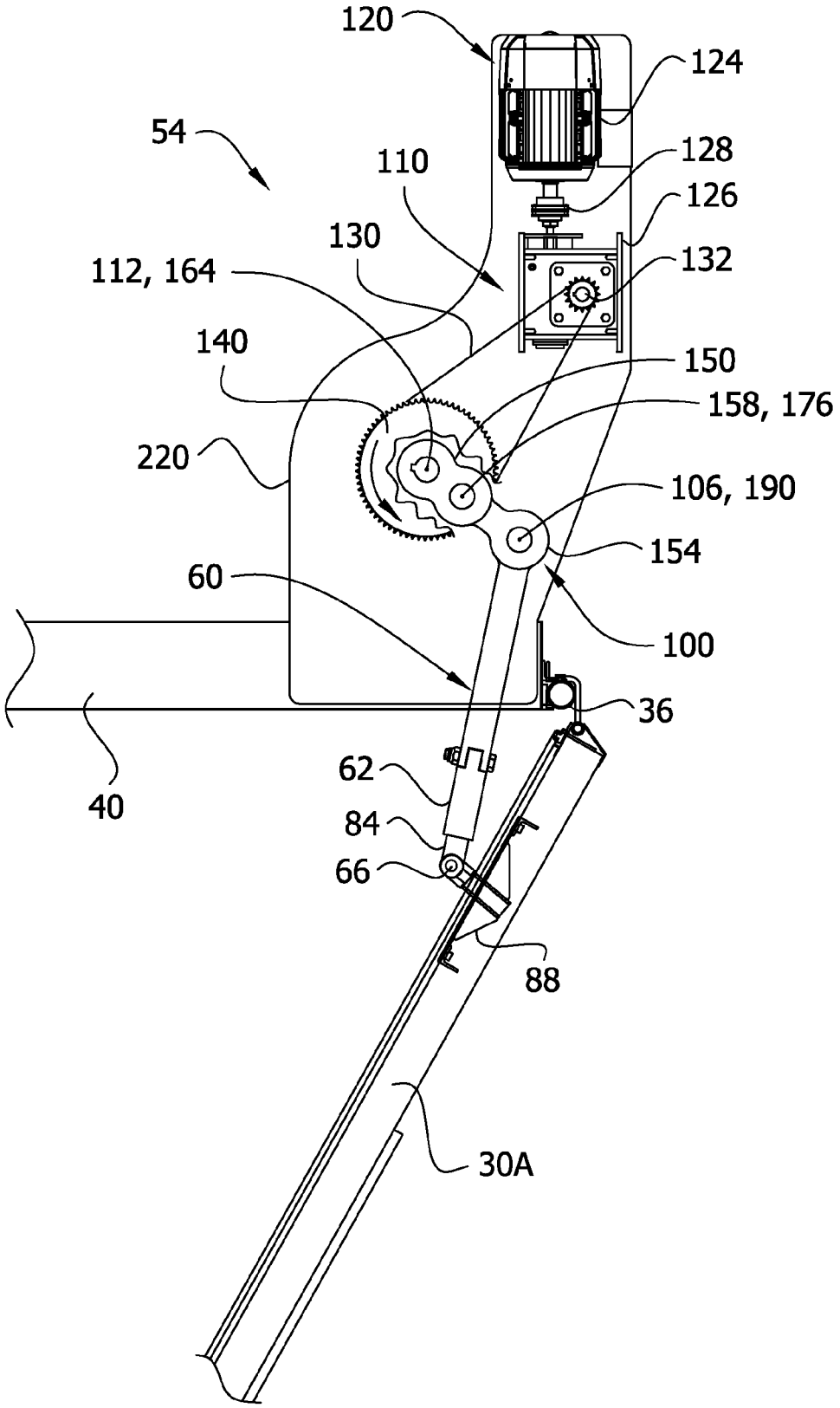
Figure 9:
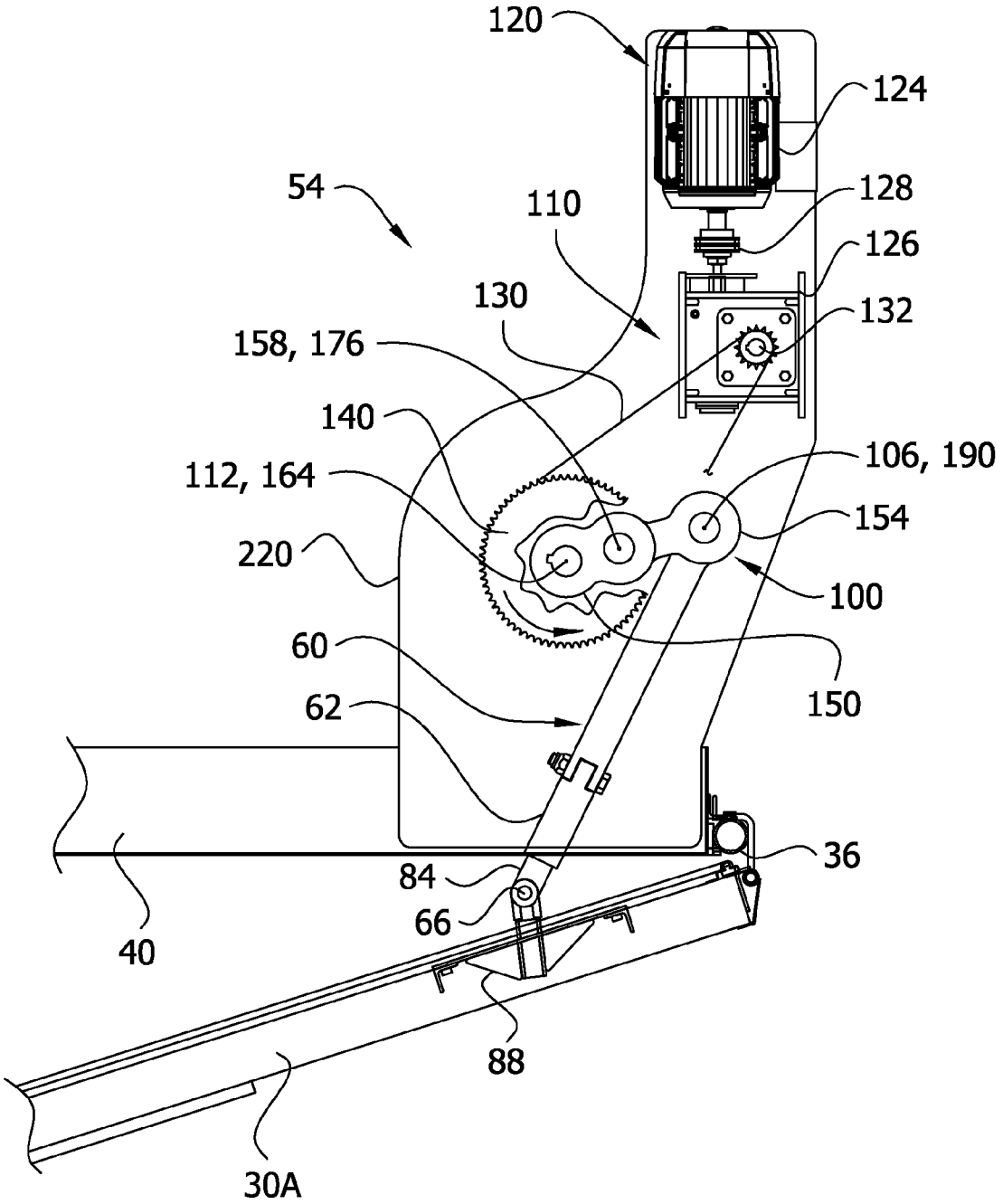

The mine door system 20 comprises a mine door, generally designated 30, adapted to be mounted on a door frame 32 installed in the passageway 14. The door frame 32 defines an entry and comprises a pair of telescoping columns 36 at opposite sides of the door frame and a lintel 40 spanning the columns. The door 30 comprises first and second door leafs 30A, 30B mounted on respective columns 36 by hinges 44, for example, for back and forth swinging movement of the door leafs between a fully-closed position (FIGS. 1 and 4) and a fully-open position (FIG. 7). When the door leafs 30A, 30B are fully closed, they are generally coplanar. Seals (not shown) are secured to the bottom edges of the door leafs 30A, 30B to seal against air flow between the leafs and the mine floor. An astragal seal 50 is secured along the free-swinging vertical edge of the first door leaf 30A to seal against air flow between the two leafs of the door. Desirably (but not necessarily), the seal 50 is secured to the high-pressure face of the first door leaf 30A and overlaps the high-pressure face of the second door leaf 30B when the two door leafs are fully closed. The opening and closing of the two door leafs 30A, 30B are sequenced to preserve the astragal seal. Thus, in an opening sequence, the first door leaf 30A carrying the astragal seal 50 preferably starts to open slightly before or at the same time as the second door leaf 30B starts to open and, in a closing sequence, the second door leaf closes before the first door leaf so that the astragal seal on the first door leaf seals properly against the high-pressure face of the second door leaf. Details on mine door and frame construction as well as other aspects of mine door usage are provided in U.S. Pat. No. 4,911,577 (Mine Door System); U.S. Pat. No. Re. 34,053 (Mine Door System); U.S. Pat. No. 5,168,667 (Door System for Mine Stopping); U.S. Pat. No. 5,222,838 (Power Mine Door System); U.S. Pat. No. 5,240,349 (Power Mine Door System); U.S. Pat. No. 6,032,986 (Door System for Mine Stopping); U.S. Pat. No. Re. 36,853 (Mine Door System); U.S. Pat. No. 6,164,871 (Mine Stopping Having a Swinging Door) and U.S. Pat. No. 6,425,820 (Mine Door Power Drive System), all of which are assigned to Jack Kennedy Metal Products, Inc. of Taylorville, Ill., all of which are hereby incorporated herein by reference.

The technology of the present invention can be applied to both single-leaf door installations and double-leaf door installations.

The mine door system 20 also includes first and second articulated door-opening mechanisms, generally designated 54, 56 (FIG. 1), for moving respective first and second door leafs 30A, 30B from their fully-closed positions to their fully-open positions. In the illustrated embodiment, the door-opening mechanisms 54, 56 are substantially identical, so only the first mechanism 54 will be described in detail. However, in other embodiments, the second door-opening mechanism 56 may differ from the first mechanism 54.

Figure 3:
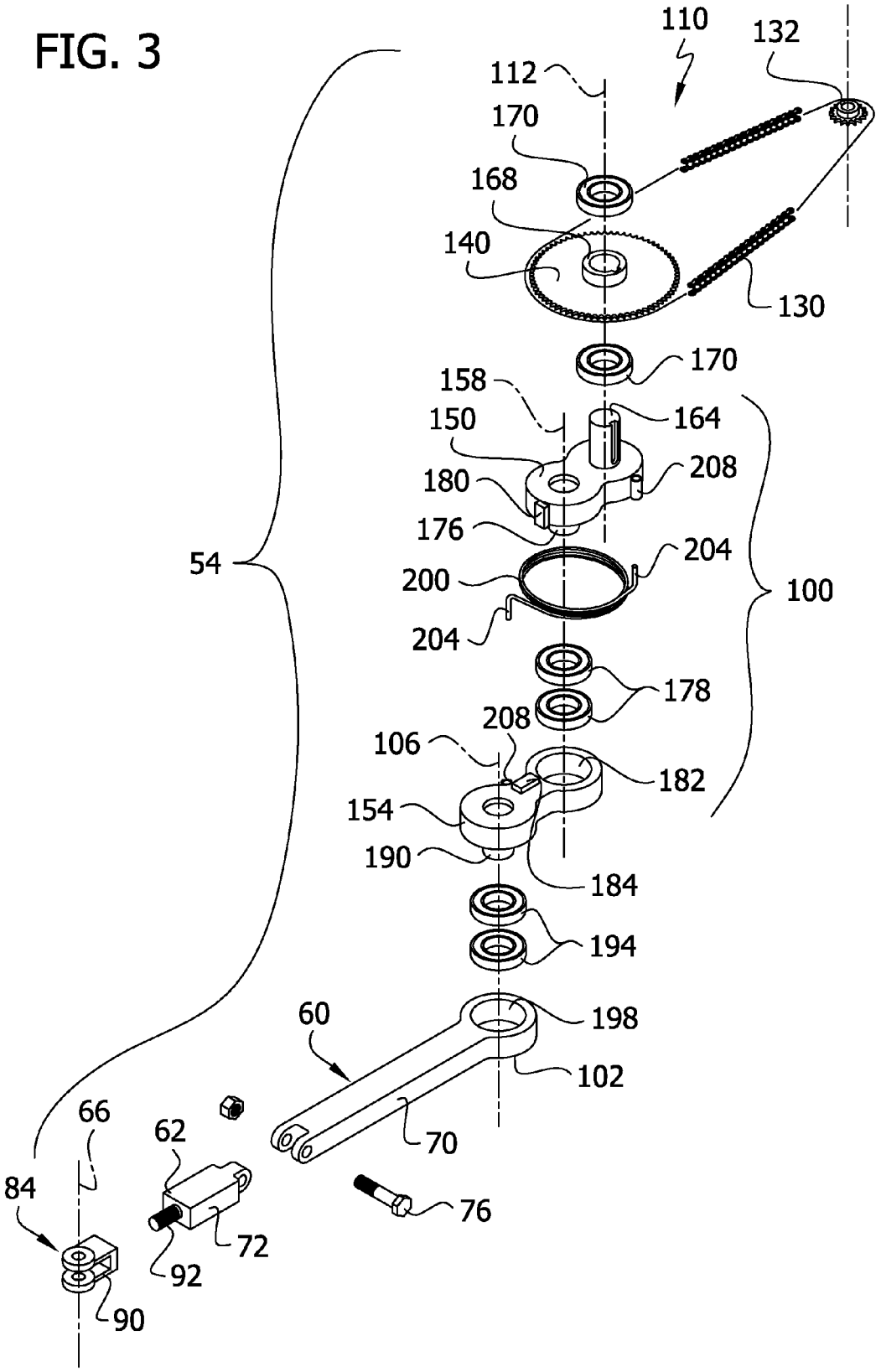
FIG. 3 is an exploded perspective of the door-moving mechanism.

Referring to FIGS. 2 and 3, the first door-opening mechanism 54 is an articulated mechanism comprising a mechanical link 60 having a first end 62 connected to the door leaf 30A for rotational movement relative to the door leaf about a first generally vertical axis 66. In the illustrated embodiment, the mechanical link 60 is elongate and comprises first and second elongate rigid members, such as steel bars 70, 72 of rectangular cross section, secured together end-to-end by a suitable fastener (e.g., a bolt 76) for pivotal movement about an axis 80 extending in a generally horizontal plane generally transversely with respect to the bars. The first end 62 of the mechanical link 60 has a pivot connection 84 to a bracket 88 affixed to the first door leaf 30A for rotational movement of the link about the vertical axis 66. The pivot connection 84 comprises a clevis 90 threaded on a threaded shaft 92 extending endwise from the second rigid member 72 of the mechanical link 60. The arrangement is such that the effective length of the mechanical link 60 can be adjusted by threading the clevis 90 along the shaft 92. The mechanical link 60 and its connection to the door leaf 30A can have other configurations without departing from the scope of this invention.

Figure 4:
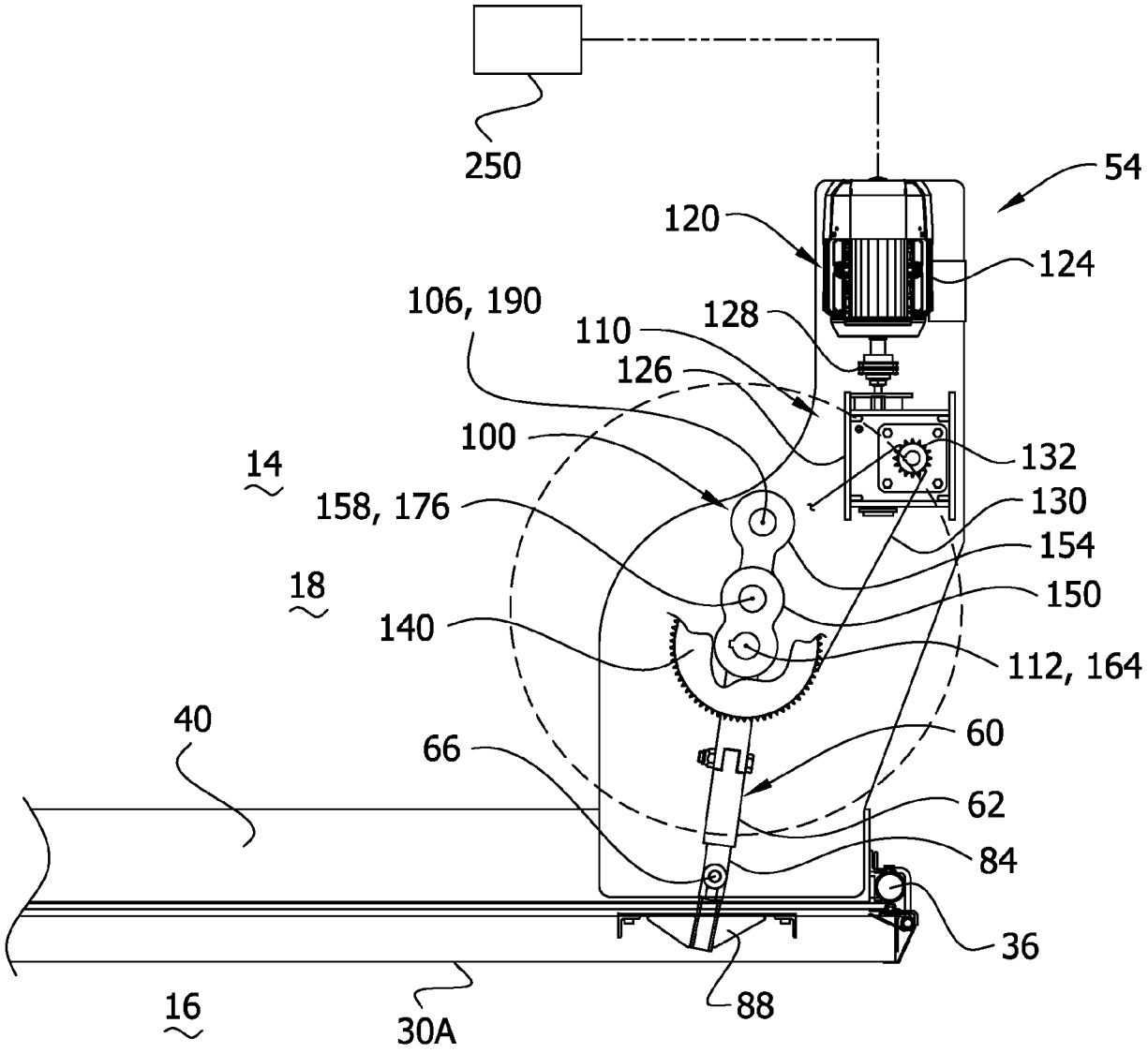
FIG. 4 is a top plan view of the door-moving mechanism showing a door leaf in a fully-closed position.

The first door-opening mechanism 54 also includes a crank, generally designated 100, connected to the mechanical link 60 toward a second end 102 of the mechanical link 60, and preferably immediately adjacent the second end of the link, for rotational movement relative to the mechanical link about a second generally vertical axis 106 spaced from the first vertical axis 66 (see FIGS. 2-4). An actuator, generally indicated at 110, rotates the crank 100 through an angular range of crank movement about a third generally vertical axis 112 spaced from the second axis 106 thereby to apply, via the mechanical link 60, an opening/closing force to the door leaf 30A.

As illustrated in FIG. 4, the actuator 110 comprises a drive unit 120 that includes a motor 124 and a speed reducer 126 connected by a coupling 128. An endless belt 130 connects a drive member comprising a sprocket 132 on the output shaft of the speed reducer 126 to a driven member comprising a sprocket 140 affixed to the crank 100. In the illustrated embodiment, the motor 124 is a non-reversing electric motor; the speed reducer 126 is a unit having an output speed in a suitable range such as 0.5-6 rpm, or 3-6 rpm, or about four rpm; and the endless belt 130 is a chain belt in mesh with the sprockets 132, 140. Desirably, a brake is provided on the motor 124 and is applied when the motor is off to prevent the door leaf 30A from coasting beyond a desired point (e.g., past dead-center positions in which the door is fully open and fully closed). The coupling 128 between the motor 124 and the speed reducer 126 may include a slip clutch to protect the motor and speed reducer in the event the door leaf 30A becomes jammed or blocked. The output shaft of the speed reducer 126 is directed in an upward direction, which is desirable in case the shaft seal fails. Other drive configurations are possible.

In the illustrated embodiment, the crank 100 is a variable-throw (variable-length) crank comprising first and second crank arms 150, 154 connected for pivotal movement relative to one another about a fourth generally vertical axis 158 located between the second and third vertical axes 106, 112, as viewed in FIGS. 2 and 3. An upper shaft 164 extends up from the first crank arm 150 adjacent a first end of the arm through a hub 168 on the driven sprocket 140 and through bearings 170 on opposite sides of the sprocket. The upper shaft 164 has a central axis coincident with the third vertical axis 112 and is keyed to the hub 168 so that the shaft and sprocket rotate in unison about the third axis. A lower shaft 176 extends down from the first crank arm 150 adjacent a second end of the arm through bearings 178 received in an opening 182 in the second crank arm 154 adjacent a first end of the second crank arm. The lower shaft 176 has a central axis coincident with the fourth pivot axis 158 and rotates freely relative to the second crank arm 154 about the fourth axis. The range of such relative rotational movement is limited by a stop mechanism comprising a first stop member 180 on the first crank arm 150 and a second stop member 184 on the second crank arm 154. A shaft 190 extends down from the second crank arm 154 adjacent a second end of the arm through bearings 194 received in an opening 198 in the mechanical link 60 adjacent the second end 102 of the arm. The shaft 190 has a central axis coincident with the second pivot axis 106 and rotates freely relative to the mechanical link 60 about the second axis.

Figure 4A:
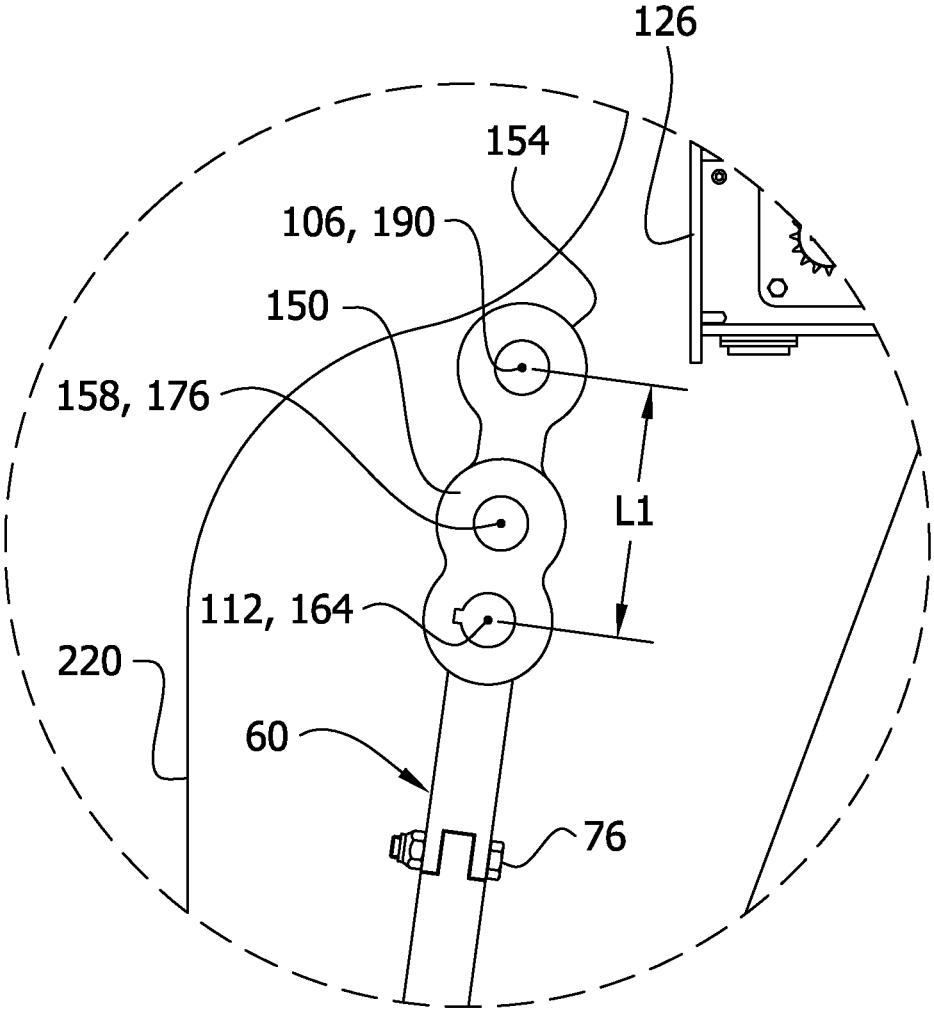
FIG. 4A is an enlarged portion of FIG. 4 with parts removed to illustrate operation of a crank mechanism.

As will be described in more detail below, the variable-throw crank 100 articulates between a first configuration (e.g., FIGS. 4 and 4A) in which it has a longer length and applies a relatively smaller door-moving force to its respective door leaf 30A, 30B and a second configuration (FIGS. 5 and 5A) in which the mechanism has a shorter length and applies a larger door-moving force to the door leaf. (The "length" of the crank 100 as used herein is the straight-line distance between the second and third pivot axes 106, 112. Compare FIG. 4A in which L1 represents the "length" of the crank 100 in its stated first (longer) configuration, and FIG. 5A in which L2 represents the "length" of the crank 100 in its stated second (shorter) configuration.)

The crank 100 assumes its first or "lengthened" configuration (e.g., FIGS. 4 and 4A) when the door leaf 30A is under a relatively light load condition. In this configuration, the second, third and fourth pivot axes 106, 112, 158 are substantially in alignment, and the length or "throw" of the crank 100 is increased to a "full-throw" or "full-length" condition. As a result, rotation of the crank about the third vertical axis 112 generates less door-opening force.

The crank 100 assumes its second or "shortened" configuration (FIGS. 5 and 5A) during conditions when the door leaf 30A is under a relatively heavy load condition. In this second configuration the second, third and fourth vertical axes 106, 112, 158 are substantially out of alignment and the length or "throw" of the crank 100 is correspondingly reduced to a "reduced-throw" or "reduced-length" configuration. As a result, rotation of the crank about the third axis 112 automatically generates more door-opening force.

Importantly, the change of the length of the crank 100 also affects the speed at which the door leaf 30A moves. In this regard, the speed at which the door moves is a function of both the angle of the crank 100 (as it rotates around axis 112) and the length of the crank. In particular, the crank-angle component of speed is substantially zero when the crank angle is zero, i.e., when the first, second, third, and fourth vertical axes 66, 106, 112, 158 are substantially aligned ("dead-center"). Desirably, the crank assumes a first dead-center position when the door leaf 30A is fully closed (FIGS. 4 and 4A) and a second dead-center position when the door leaf is fully open (FIG. 7). The crank-angle component of the door-moving speed increases smoothly from zero as the crank 100 rotates away from its first dead-center position up to a maximum value and then decreases smoothly back to zero as the crank 100 rotates to its second dead-center position. Similarly, the crank-angle component of the door-moving speed increases smoothly from zero as the crank 100 rotates away from its second dead-center position up to a maximum value and then decreases smoothly back to zero as the crank 100 rotates back to its first dead-center position. The crank-throw component of speed varies from a relatively large value when the crank 100 is in its first (longer) configuration and a smaller value when the crank is in its second (shorter) configuration. The speed at which the door moves at any given time is a function of the crank-angle speed component and the crank-throw speed component.

A holding device 200 holds the variable-throw crank 100 in its first (full-throw) configuration in which the second, third and fourth vertical axes 106, 112, 158 are substantially in alignment. In the illustrated embodiment, the holding device 200 is a helical torsion spring (also designated 200, for convenience) having a central vertical axis generally coincident with the fourth vertical axis 158. The spring 200 has first and second end portions 204 bent vertically for reception in vertical sleeves 208 mounted on the first and second crank arms 150, 154, respectively (see FIGS. 2 and 3). The spring 200 is configured to hold the crank 100 in its first (full-throw) configuration until the force required to open the door leaf 30A exceeds a predetermined amount, as during heavy load conditions, at which point the spring will deflect resiliently (i.e., wind up) under the load from its "home" configuration to allow the crank to move to its second (reduced-throw) configuration. When the force required to open the door leaf falls below the predetermined amount, the spring 200 will return (i.e., unwind) under its own resilient power to its "home" configuration to force the crank 100 back toward its first configuration (full-throw) configuration. Other types of springs and spring arrangements can be used for holding the crank 100 in a full-throw (increased-throw) configuration during light-load conditions while allowing the crank to move to a reduced-throw configuration during heavier load conditions. The amount of force required to deflect the spring 200 will depend on the configuration of the spring and its spring characteristic. The force to be exerted by the spring on the door leaf 30A is selected based on such factors as the size of the door leaf, operating speed, friction, and the power on the drive. The spring should have sufficient power to straighten the crank by overcoming the various frictions in the system, such as door seal flaps dragging on the floor of the mine, after the air load on the door leaf is substantially or entirely eliminated.

Devices other than a torsion spring can be used for holding the crank 100 in its first configuration while allowing the articulated door-moving mechanism to move toward its second configuration when the force for opening the door exceeds a predetermined amount. By way of example, other types of springs can be used, such as a gas spring, coil spring, leaf spring, or other spring arrangement. A non-spring powered or fixed mechanical mechanism can also be used, such as a cam mechanism, or an eccentrically-operated mechanism, or a motor or other powered device which positively moves the crank 100 between its first and second configurations.

The door-opening mechanism 54 is mounted in an enclosure or housing 220 secured in suitable fashion (e.g., welded or fastened) to the lintel 40 of the door frame 32. The housing 220 extends like a cantilever from the lintel 40 and is supported at its free (outer) end by a brace 224.

A suitable control system 250 (FIG. 4) is provided for controlling the operation of the motor 124 of the door-moving mechanisms 54. (The same or similar control system is used for controlling the operation of the door-moving mechanism 56.) In one embodiment, the control system 250 is mounted close to the mine door 30 for operation by a person near the door. The control system can include a programmable processor for programming the opening and closing sequence and/or speeds of the door leafs. The control system may also be used to control signal lights and alarms associated with the mine door.

FIGS. 4-9 are schematic views illustrating a typical opening sequence of the first door leaf 30A.

FIG. 4 shows the first door leaf 30A in its fully closed position in which the door leaf is closely adjacent or bearing against the lintel 40. In this position, the crank 100 is in its first (full-throw) configuration and in (or close to) a dead-center position in which the first, second, third and fourth vertical axes 66, 106, 112, 158 are substantially aligned; and the fourth axis 158 at the connection between the two crank arms 150, 154 is located between the second and third axes 106, 112. In this position, the air-pressure differential across the door 30 exerts a strong static force resisting movement of the door leaf 30A away from its fully-closed position.

Figure 5:
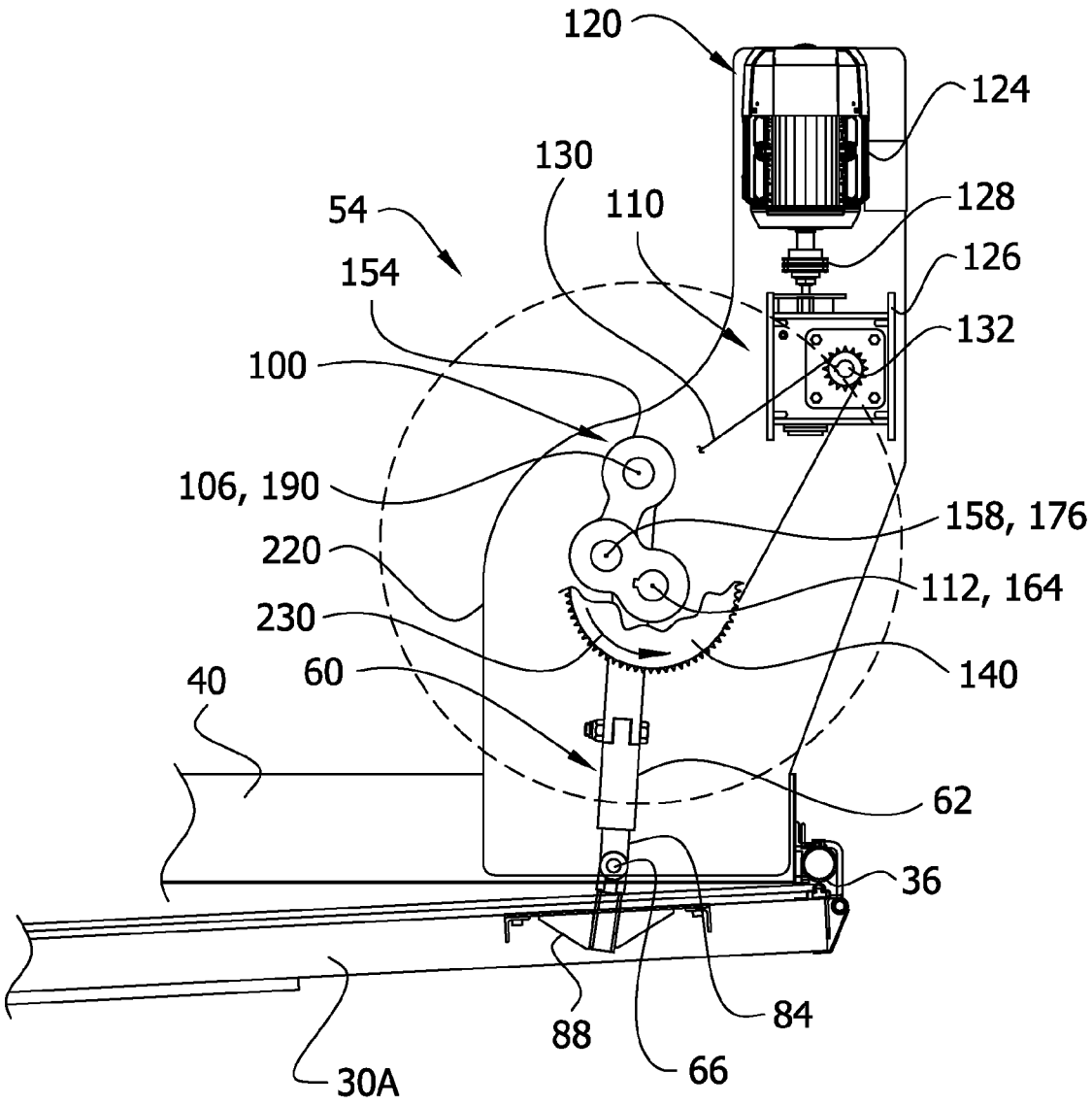
FIG. 5 is a top plan view of the door-moving mechanism showing the door leaf and crank mechanism after the door has moved through an initial-opening segment.
Figure 5A:
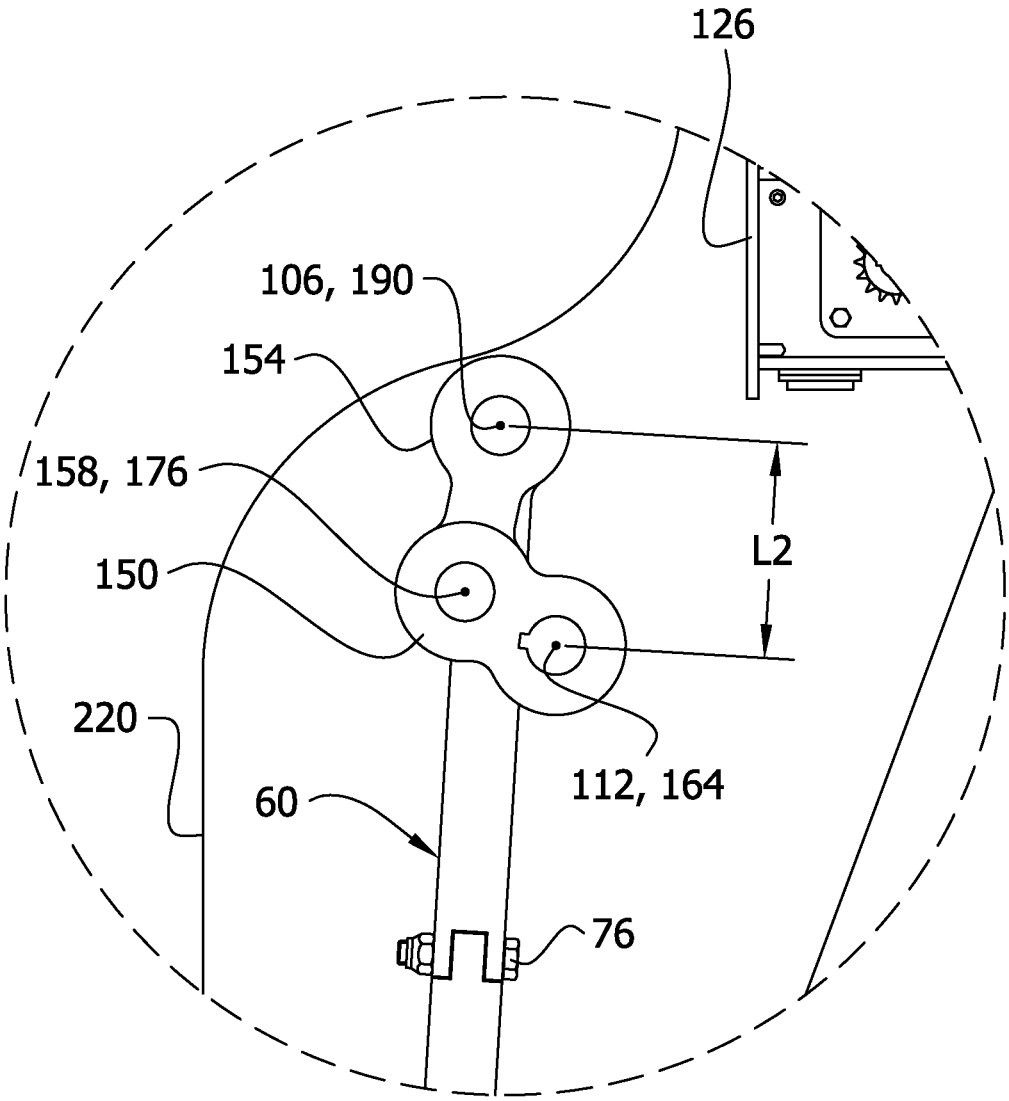
FIG. 5A is an enlarged portion of FIG. 5 with parts removed to illustrate operation of the crank mechanism.

FIGS. 5 and 5A show the door leaf 30A after the motor 124 has been actuated to rotate the driven sprocket 140 and crank 100 a short distance in a counterclockwise direction (as indicated by the arrow 230) about the third axis 112 through a relatively small crank angle increment. The rotational movement of the crank 100 through this increment is transmitted to the mechanical link 60 which moves the door leaf 30A through an initial-opening segment of movement. The resistance pressure against the door leaf 30A during this segment is relatively large and exceeds the amount required to deflect the spring 200. In this regard, the resistance pressure against the door leaf 30A when the door leaf is in its fully-closed position is due to the static pressure differential across the door leaf. There is no velocity pressure component, because there is no air flow past the door leaf. As the door leaf starts to open and air begins to flow past the leaf, the resistance pressure actually increases due to a velocity pressure component added to the static pressure component. In response to the relatively large pressure resistance, the second crank arm 154 rotates against the urging of the spring 200 about the fourth axis 158 in a counterclockwise direction relative to the first crank arm 150 toward the second (reduced-throw) configuration of the crank 100. The shortened crank 100 automatically results in the application of a greater door-opening force to the door leaf 30A and a corresponding reduction in the crank-throw speed component. It will be observed that the mechanical link 60 remains generally perpendicular to the plane of the door leaf 30A during this segment of movement for maximum efficiency. Also, the crank action causes the speed at which the door leaf 30A moves to increase smoothly from zero as it moves away from its fully-closed position.

Figure 6:
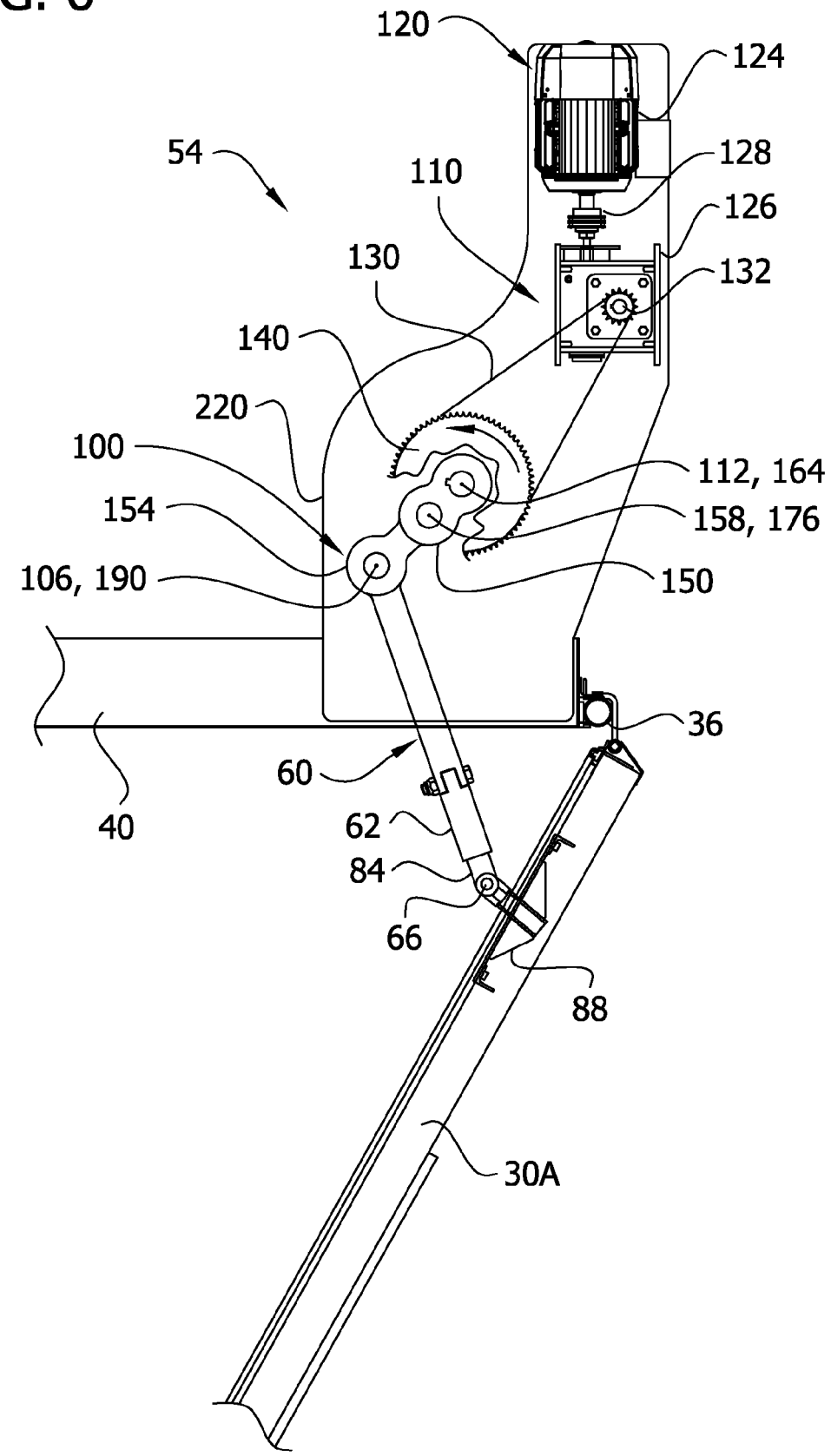
FIGS. 6-9 are top plan views illustrating a sequence of door movement from the position shown in FIG. 5 to a fully-open position and back to a fully-closed position, portions being broken away to show details and principles of the action of the crank mechanism.

FIG. 6 shows the door leaf 30A after the motor 124 has rotated the sprocket 140 and crank 100 in a counterclockwise direction about the third vertical axis 112 through another crank angle increment of movement. As the crank 100 moves through this increment, the rotational movement of the crank is transmitted to the mechanical link 60 to move the door leaf 30A through a mid-opening segment of movement. The resistance pressure against the door during this segment is substantially less than the resistance pressure during the initial-opening segment of movement and is less than the amount required to deflect the spring 200. As a result, the crank 100 returns under the bias of the spring to its first (full-throw) configuration. The longer throw of the crank 100 automatically results in the application of a smaller door-opening force to the door leaf 30A and a corresponding increase in the crank-throw speed component. As a result, the speed at which the door opens automatically increases, which is desirable.

FIG. 7 shows the door leaf 30A after the motor 124 has rotated the sprocket 140 and crank 100 in a counterclockwise direction about the third vertical axis 112 through another crank angle increment of movement. As the crank 100 moves through this increment, the rotational movement of the crank is transmitted to the mechanical link 60 to move the door leaf 30A to move the door leaf 30A through a final-opening segment of movement to a fully-open position in which the crank 100 is again in a dead-center position (its second dead-center position). The resistance pressure against the door leaf during this final-opening segment is typically relatively small, i.e., less than the amount required to deflect the spring 200. As a result, the crank 100 remains in its first (full-throw) configuration. The crank action causes the speed at which the door leaf 30A moves to decrease smoothly down to zero as it approaches its fully-open position.

To move the door leaf from its fully-open position (FIG. 7) back to its fully-closed position (FIG. 4), the motor 124 is operated to rotate the sprocket 140 and crank 100 in the same (counterclockwise) direction about the third axis 112 through an initial-closing segment (FIG. 8), a mid-closing segment (FIG. 9), and a final-closing segment. The crank action causes the speed at which the door leaf 30A moves to increase smoothly from zero to a maximum speed as it moves away from its fully-open position and then to decrease smoothly to zero as it reaches its fully-closed position. During closing movement, the crank will normally stay in its second (full-throw) configuration since less power is needed to close the door.

Thus, in the illustrated embodiment, the variable-throw crank 100 is configured to pivot in one direction along a circular path of about 360 degrees as the door leaf moves from its fully-closed position to its fully-open position and then back to its fully-closed position. In other embodiments, a reversing motor (or other reversing drive) is used to rotate the crank (e.g., 180 degrees) in one direction to open the door leaf and in the opposite or reverse direction (e.g., 180 degrees) to close it.

It will be observed from the above that the operation of the crank 100 moves the door leafs 30A, 30B from a zero speed (at the first dead-center position) to a relatively high speed and back to a zero speed (at the second dead-center position) as the leafs move between their fully-open and fully-closed positions. Significantly, the transitions between these speeds are infinitely smooth to reduce jarring forces to the door system and surrounding structure. The crank can be a fixed-length crank or a variable-length crank to achieve this advantage, and this invention contemplates the use of both such embodiments.

The pivot or knuckle connection 76 between the two rigid members 70, 72 of the mechanical link 60 allows limited vertical movement between the door leaf 30A and the crank 100 as the door leaf opens and closes to avoid binding of the crank bearings 170, 178, 194.

The operation of the second door-opening mechanism 56 to open and close the second door leaf 30B is similar to the operation of the first door-opening mechanism 54 described above. As note previously, the opening and closing of the door leafs 30A, 30B are preferably sequenced such that the door leaf 30A with the astragal seal 50 starts its initial movement at least slightly before the initial opening movement of the other door leaf 30B to avoid damage to the seal, and such that the door leaf 30A with the astragal seal arrives back at its fully-closed position at least slightly after the other door leaf 30B has reached its fully-closed position to insure proper sealing.

The crank design of this invention provides advantages over conventional hydraulic or pneumatic door-operating systems. By way of example, the crank design is less complex and less costly. Additionally, the action of the variable-throw crank allows greater operating speed because it automatically reduces the momentum of the door leaf as it stops and starts. The crank design insures a very smooth transition from zero speed with corresponding low reaction back to the frame 32 as the door leaf gains momentum, a very high mid-stroke speed for a quick opening time, and a very smooth transition from high speed back to zero speed with little momentum delivered to the frame. The smoothness in transitioning between speeds (i.e., smooth acceleration and deceleration) reduces the risk of damage to the door frame 32, to the surrounding structure, and to the seals on the door leafs. Further, the crank design provides a large advantage in mechanical advantage or leverage when the door leaf is starting to open against a heavy air load. Then, when the air load is reduced (e.g., due to the door being open a little and the air able to flow through the opening), the speed of door movement automatically increases, trading thrust or force for speed. Also, the line of force exerted by the crank 100 and mechanical link 60 is more perpendicular (closer to perpendicular) to the door leaf when it is opening, and less perpendicular (farther away from perpendicular) as the door leaf is more fully opened. This is advantageous because the better the vector against the door leaf the more efficient the design, i.e., it takes less force to open the door leaf if you are pushing squarely against it, and more force if you are vectored off at an angle to it. After the air load is overcome and greater force is not required, the door trades the square vector for a more oblique one so the door speeds up and automatically trades force for speed as the load is reduced. As a result, the door leaf moves more slowly from its fully-closed position to its fully-open position and more rapidly from its fully-open position to its fully-closed position. By way of example but not limitation, the door leaf 30A may open in about eight seconds as the crank rotates through a first segment of about 180 degrees and close in about six seconds as it moves through a second segment of about 180 degrees.

It will also be observed that the connection of the mechanical link 60 to the door leaf 30A is more toward the center of the entry when the door is closed and swings to the side as the door is opened. This design is advantageous in that the mechanical and connection hardware is moved out of the center of the entry to provide greater clearance through the open entry but is still located to push at a point some distance from the hinge to get a significant mechanical advantage.

The control system 250 controls the operation of the motors 124 of both door-opening mechanisms 54, 56, preferably independent of one another. As a result, the control system 250 is able to control the movement of each door leaf independent of the other door leaf to achieve the desired opening and closing times of each door leaf, the sequence of movement of one door leaf relative to the other door leaf, and any other variations in movement that may be desirable.

The motors 124 can be reversing motors rather than non-reversing motors. However, a non-reversing motor arrangement is typically less expensive. Further, rotating the crank 100 in one direction only has a leverage advantage. If the crank is arranged to turn so that the throw starts to move outward, toward the center of the entry as the mechanism starts to open the door, the crank 100 and mechanical link 60 automatically start to get a better purchase through a more perpendicular vector to the door leaf. Also, since the crank 100 keeps turning in the same direction to close the door leaf that it did to open it, the design automatically trades the opening force vector for a closing speed vector, which is desirable. Force is not needed to close the door leaf, only to open it since the pressure differential across the door leaf tends to close it.

As previously noted, in the illustrated embodiment the door-opening mechanisms 54, 56 are substantially identical. However, in other embodiments, the second door-opening mechanism 56 may differ from the first mechanism 54. By way of example, the first door-opening mechanism 54 may include a variable-length crank mechanism, as described above, and the second door-opening mechanism may not include a variable-length crank mechanism. In that case, the first mechanism could be operated to open the first door leaf 30A first to relieve the air load on the door, and the second mechanism then operated.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A method of opening a mine door leaf installed in a mine passageway, said passageway having a first pressure zone on a first side of said door leaf and a second pressure zone on a second side of said door leaf, the first pressure zone having a pressure that is higher than a pressure of the second pressure zone, the method comprising:

operating a variable-throw crank mechanism in a first configuration having a first crank length to apply a first force to the mine door leaf to move the mine door leaf at a first speed, operating the variable-throw crank mechanism in a second configuration having a second crank length less than the first crank length to apply a second force greater than the first force to the mine door leaf to move the mine door leaf at a second speed slower than the first speed, and using a resistance pressure associated with the first and second pressure zones in the mine passageway to convert the variable-throw crank mechanism from the first configuration to the second configuration.

2. A method as set forth in claim 1 further comprising converting the variable-throw crank mechanism from the second configuration to the first configuration in response to a decrease in said resistance pressure and using said first force to open the mine door leaf at said first speed following the decrease in said resistance pressure.

3. A method as set forth in claim 1, wherein said method further comprises rotating said variable-throw crank mechanism through approximately 360 degrees in one direction to move the door leaf from a fully-closed position to a fully-open position and then back to said fully-closed position.

4. A method as set forth in claim 1, wherein said method further comprises rotating said variable-throw crank mechanism through approximately 180 degrees in a first direction to move the door leaf from a fully-closed position to a fully-open position and then rotating the variable-throw crank mechanism through approximately 180 degrees in a second direction opposite to the first direction to move the door leaf back to said fully-closed position.

5. A method as set forth in claim 1 wherein the step of using said resistance pressure to convert the variable-throw crank mechanism from the first configuration to the second configuration includes using a velocity pressure component associated with air flow past the door leaf as the door leaf opens to convert the variable-throw crank mechanism from the first configuration to the second configuration.

6. A method as set forth in claim 1 wherein the variable-throw crank mechanism is converted from the first configuration to the second configuration as the door leaf moves through an initial opening movement.

7. A method as set forth in claim 6 further comprising converting the variable-throw crank mechanism from the second configuration to the first configuration in response to a decrease in said resistance pressure following movement of the door leaf through the initial opening movement.

8. A method as set forth in claim 1 further comprising converting the variable-throw crank mechanism from the second configuration to the first configuration in response to a decrease in said resistance pressure following movement of the door leaf through an initial opening movement.

9. A method as set forth in claim 8 wherein the step of converting the variable-throw crank mechanism from the second configuration to the first configuration comprises using a spring.

10. A method as set forth in claim 9 wherein the step of using said resistance pressure to convert the variable-throw crank mechanism from the first configuration to the second configuration comprises overcoming a force applied by the spring biasing the variable-throw crank mechanism toward the first configuration.

11. A method as set forth in claim 10 further comprising decreasing a speed at which the door leaf rotates as the door leaf approaches a fully-open position while the variable-throw crank mechanism remains in the first configuration and is driven by a motor.

12. A method as set forth in claim 11 further comprising using a motor to rotate the variable-throw crank mechanism to move the door leaf from a closed position to the fully-open position and from the fully-open position back to the closed position without reversing the direction the motor rotates the variable-throw crank mechanism.

13. A method as set forth in claim 1 further comprising using a motor to rotate the variable-throw crank mechanism to move the door leaf from a closed position to an open position and from the open position back to the closed position without reversing a direction the motor rotates the variable-throw crank mechanism.

14. A method as set forth in claim 13 wherein the variable-throw crank mechanism comprises first and second crank arms connected together for pivotal movement relative to one another, the first crank arm being connected between the second crank arm and the motor, the method further comprising using the motor to rotate the first crank arm in said direction through an angle of rotation of approximately 360 degrees to drive the door leaf from the closed position to the open position and from the open position back to the closed position.

15. A method as set forth in claim 14 wherein the step of converting the variable-throw crank mechanism from the first configuration to the second configuration comprises rotating the first and second crank arms relative to one another.

16. A method as set forth in claim 15 wherein variable-throw crank mechanism is biased toward the first configuration by a biasing force and wherein the step of converting the variable-throw crank mechanism from the first configuration to the second configuration comprises allowing the resistance pressure to rotate the first and second crank arms relative to one another against the biasing force.

17. A method as set forth in claim 16 wherein the resistance pressure includes a velocity pressure component associated with air flow past the door leaf as the door leaf opens.

18. A method as set forth in claim 17 wherein the variable-throw crank mechanism is converted from the first configuration to the second configuration as the door leaf moves through an initial opening movement.

19. A method as set forth in claim 1 wherein the variable-throw crank mechanism comprises a first crank arm, a second crank arm, a crank bearing, and a mechanical link, the first and second crank arms being connected together for pivotal movement relative to one another, the first crank arm being connected between the second crank arm and a motor configured to rotate the variable-throw crank mechanism, the second crank arm being connected between the first crank arm and the mechanical link, the crank bearing being positioned at an end of at least one of the first and second crank arms to facilitate the pivoting movement of said at least one of the crank arms, wherein the mechanical link comprises a pair of members connected by a connection allowing pivoting movement of the members relative to one another about a generally horizontal axis, the method further comprising:

allowing the mechanical link to pivot at said connection in response to vertical movement of the door leaf relative to the variable-throw crank mechanism to limit binding of the crank bearing.

* * * * *